US006176062B1

(12) United States Patent
Fayle

(10) Patent No.: US 6,176,062 B1
(45) Date of Patent: Jan. 23, 2001

(54) POLE PROTECTOR

(75) Inventor: Michael J. Fayle, Elma, NY (US)

(73) Assignee: Osmose Wood Preserving, Inc., Buffalo, NY (US)

( * ) Notice: Under 35 U.S.C. 154(b), the term of this patent shall be extended for 0 days.

(21) Appl. No.: 08/596,494

(22) Filed: Feb. 5, 1996

(51) Int. Cl.[7] ..... E04C 3/30
(52) U.S. Cl. ..... 52/736.4; 52/301; 405/216
(58) Field of Search ..... 52/736.3, 736.4, 52/726.4, 301, 730.4, 723.2, 723.1, 515, 738.1, 737.5, 737.1, 170; 405/216

(56) References Cited

U.S. PATENT DOCUMENTS

| | | | |
|---|---|---|---|
| 3,181,849 | 5/1965 | Mitchell | 267/1 |
| 3,416,484 | 12/1968 | Chapman | 116/67 |
| 3,602,109 | 8/1971 | Harrington | 94/1.5 |
| 3,890,795 * | 6/1975 | Maurer | 52/170 X |
| 4,183,505 | 1/1980 | Maestri | 256/13.1 |
| 4,244,156 * | 1/1981 | Watts, Jr. | 52/736.4 X |
| 5,299,883 | 4/1994 | Arth, Jr. | 404/10 |
| 5,311,713 * | 5/1994 | Goodrich | 52/736.4 X |
| 5,369,925 | 12/1994 | Vargo | 52/244 |
| 5,397,197 | 3/1995 | Beavers | 404/10 |
| 5,513,477 * | 5/1996 | Farber | 52/736.3 X |

OTHER PUBLICATIONS

"Guide to Pole Conversation & Repair Products" brochure of Osmose Wood Preserving, Inc., 1994.

* cited by examiner

*Primary Examiner*—Creighton Smith
(74) *Attorney, Agent, or Firm*—James C. Simmons

(57) ABSTRACT

In order to protect a pole from low-speed impacts, an inner shell of impact-absorbing material is wrapped about the pole and an outer shell of a tough material is wrapped about the inner shell for protecting the inner shell from damage while intactly resisting the low-speed impacts.

20 Claims, 1 Drawing Sheet

POLE PROTECTOR

The present invention relates generally to structures for protection of utility poles and the like.

Various guards, fenders, and the like for protection of poles, guard posts, pilings, and the like are disclosed in U.S. Pat. Nos. 3,181,849; 3,416,484; 3,602,109; 4,183,505; 4,244,156; 5,299,883; 5,369,925; and 5,397,197. For example, U.S. Pat. No. 4,244,156 to Watts, Jr. discloses a pole and piling protector comprising a tubular plastic shell having a foamed adhesive beneath the shell. It is stated that the foamed adhesive provides a supporting cushion for the shell that inhibits cracking or puncturing from impact. The adhesive foams in place during application to form a layer between the shell and piling. U.S. Pat. No. 4,183,505 to Maestri discloses a guard barrier system comprising cylindrical bumper elements made of a tire material and axially mounted on posts for rotation thereon. Safety barriers filled with sand have been placed next to telephone poles. Plate steel splits have been provided on telephone poles to protect woodpecker damage as well as to act as braces.

It is considered desirable to provide an inexpensive yet effective protector for utility poles, sometimes called telephone poles, and the like which will protect the poles from damage such as abrasions caused by low-speed vehicular impacts. It is also considered desirable that these protective structures be able to withstand such low-speed impacts so that they need not be replaced often. However, a good impact-absorbing material such as a foam tends to tear during such low-speed impacts. The adhesive application of the inner layer of the Watts, Jr. protector does not allow the desired inner layer thickness to be achieved for adequate impact absorption.

It is accordingly an object of the present invention to provide an inexpensive yet effective pole protector which will withstand such low-speed impacts.

It is another object of the present invention to provide such a pole protector which does not quickly deteriorate so that it is long-lasting.

In order to provide a pole protector which is inexpensive, effective, and will withstand such low-speed impacts, in accordance with the present invention an inner shell of impact-absorbing material is placed around the pole and an outer shell is placed around the inner shell for protecting the inner shell from tearing and other damage during low-speed impacts and intactly resisting the low-speed impacts. In order that the inner shell material not quickly deteriorate due to absorption of water, it is preferably a closed-cell foam.

The above and other objects, features, and advantages of the present invention will be apparent in the following detailed description of the preferred embodiment thereof when read in conjunction with the following drawings wherein the same reference numerals denote the same or similar parts throughout the several views.

DETAILED DESCRIPTION OF THE PREFERRED EMBODIMENT

Figure 1:
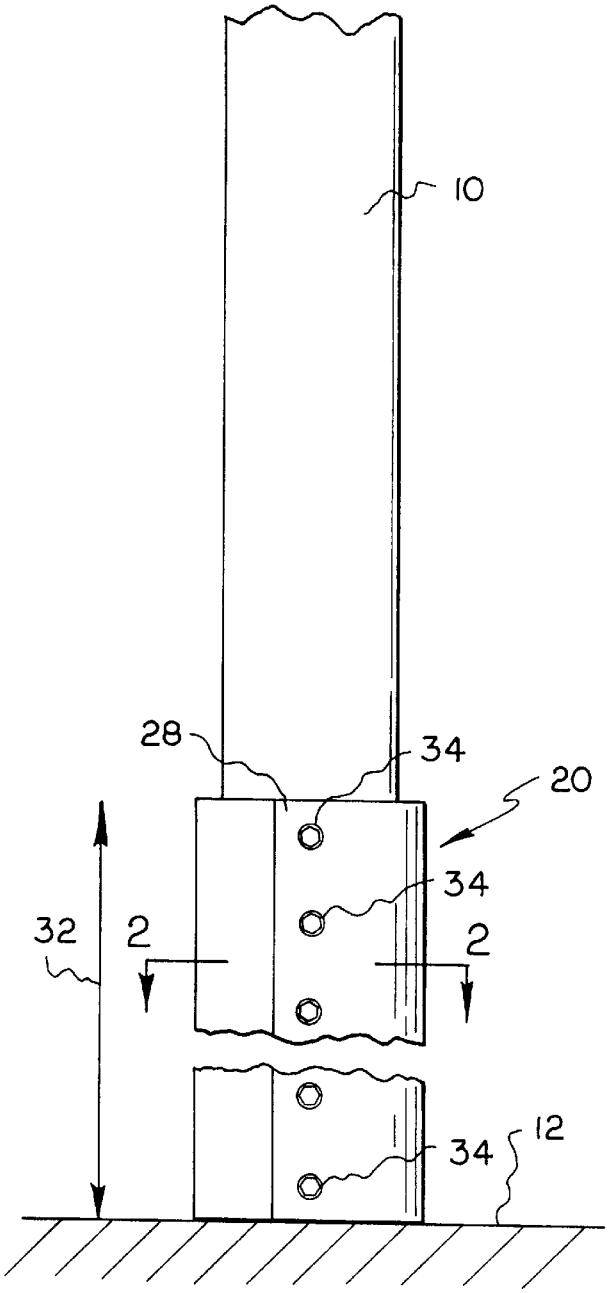
FIG. 1 is a partial elevation view of a telephone pole and pole protector which embodies the present invention.
Figure 3:
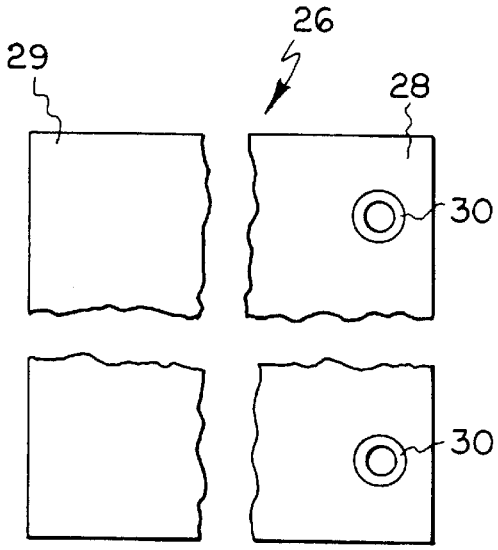
FIG. 3 is a partial plan view of an outer shell therefor before its application to the pole.

Referring to the drawings, there is shown at 10 a wood utility pole planted in the ground 12. It should be understood that the present invention may be used with various other kinds of poles or posts or pilings such as a post acting as a fender in a parking garage. The term "post", as used herein and in the claims, is thus meant to include posts or pilings or other standing members.

Utility poles in some locations are subject to frequent low-speed impacts by vehicles. In order to protect the poles as well as the vehicles from damage due to such low-speed impacts, a pole protector, illustrated generally at 20, is provided to protect the pole 10 and vehicle. The pole protector 20 may also be provided to protect people or animals coming in contact therewith. For example, pole protectors 20 may be provided around poles, posts, pilings, and the like in playgrounds, residential backyards, horsetracks, piers, docks, and marinas as well as poles located adjacent streets or highways.

The pole protector 20 is a two-piece structure which includes an inner shell 22 composed of a foam material or other suitable impact-absorbing material. The inner shell material suitably has a good compression deflection when an applied force of about 2 to 5 psi (low speed impact) is applied thereto. Thus, it is believed that the inner shell material should have about a compression deflection in the range of about 20 to 30 percent when about 2 to 5 psi (pounds per square inch gage) of impact force is applied thereto. In order that the impact-absorbing material not undesirably absorb water so that it will not promote decay which would cause the wooden pole to quickly deteriorate, it is preferably a closed-cell foam. For example, the impact-absorbing material may be neoprene foam.

The inner shell 22 is a flat material which has a width equal substantially to the circumference of the pole 10 and is wrapped so as to circumscribe the pole with its opposite edges coming together in an abutting relation, as illustrated at 24. The inner shell 22 may have a thickness of perhaps about 1¼ inch or other suitable thickness providing the desired impact-absorption capacity. This thickness may be determined using principles commonly known to those of ordinary skill in the art to which this invention pertains.

The foam material of the inner shell is by itself subject to tearing and ripping during low-speed impacts (2 to 5 psi of applied force) so that it would undesirably have to be replaced frequently if not otherwise protected from such damage. In order to provide such protection of the inner shell, in accordance with the present invention, the pole protector 20 is provided with an outer shell 26 composed of a material which provides toughness to protect the inner shell material from damage during low-speed impacts while intactly resisting the low-speed impacts. A suitable outer shell material is, for example, polyvinylchloride reinforced with heat set high tenacity polyester yarns, pretensioned in the loom, so that the stretch is minimized to less than about 1½ percent of the original length, the material having a strength of perhaps about 1200 psi. It is believed that the strength of the outer shell should suitably be at least about 800 psi.

Suitable polyester reinforced polyvinylchloride for the outer shell and neoprene foam material (having about a 25 percent compression deflection at an applied force of about 2 to 5 psi) for the inner shell may be obtained from Shields Rubber Company of Erie, Pa.

The outer shell 26 is a flat material which has a width which is greater than the outer circumference of the inner shell 22 and has grommets 30 suitably spaced along the length of one edge portion 28. The outer shell 26 is wrapped so as to circumscribe the inner shell 22 with the edge portion 28 overlapping the opposite edge portion 29 so that the edge portions 28 and 29 may be connected as hereinafter described. The width of the outer shell 26 is desirably selected to accommodate the largest diameter pole to which the pole protector 20 may be applied. The outer shell thickness may, for example, be about ⅛ inch.

The inner and outer shells 22 and 26 respectively desirably have the same height, illustrated at 32, which will vary depending on the particular application requirements. For utility poles, this height 32 will typically be between about 2 and 6 feet.

Figure 2:
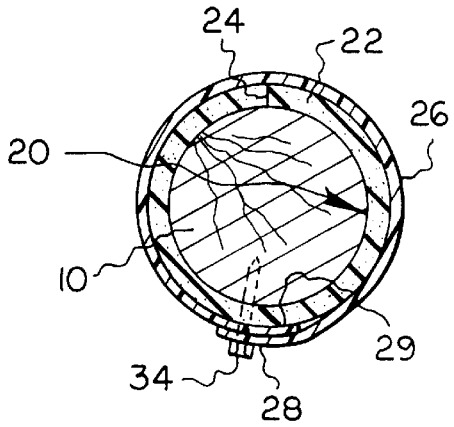
FIG. 2 is a section view thereof taken along lines 2—2 of FIG. 1.

The outer shell 26 also serves as a means for holding the inner shell 22 in place. Thus, the inner shell 22 is temporarily held in place by, for example, tape until the outer shell 26 is applied. As seen in FIG. 2, the outer shell 26 is wrapped about the inner shell so that the edge portion 28 overlaps the opposite edge portion 29, and a lag bolt 34 is passed through each of the grommets 30, through the outer shell portion 29 then the inner shell 22, and screwed into the pole 10. It should of course be understood that the opposite edge portions 28 and 29 may be attached to each other by other suitable means.

It should be understood that, while the present invention has been described in detail herein, the invention can be embodied otherwise without departing from the principles thereof, and such other embodiments are meant to come within the scope of the present invention as defined by the appended claims.

What is claimed is:

1. A method of providing protection about a wood pole, the method comprising the steps of (a) wrapping about the pole an inner shell having a height and composed of a material which is selected for absorbing impacts thereby circumscribing the pole with the inner shell, (b) circumscribing the inner shell over substantially the height of the inner shell with an outer shell having a height which is substantially equal to said inner shell height and which outer shell is composed of a material which is selected to protect the inner shell from damage while the outer shell intactly resists the impacts, (c) selecting the inner shell to be wrapable about the pole separately of the outer shell, and (d) selecting the inner shell material to be a closed-cell foam material.

2. A method according to claim 1 comprising selecting the inner shell material to have a compression deflection in the range of about 20 to 30 percent when about 2 to 5 psi of force is applied thereto.

3. A method according to claim 2 comprising selecting the outer shell material to have a strength of at least about 800 psi.

4. A method according to claim 1 further comprising holding the inner shell in place while attaching opposite edge portions of the outer shell to each other.

5. A protector for a wood pole comprising means for absorbing impacts with a wood pole, said impact-absorbing means including an inner shell which has a height and which is adapted for circumscribing the pole and which is composed of impact-absorbing material, the pole protector further comprising means for protecting said inner shell from damage during the impacts while intactly resisting the impacts, said protecting and impact resisting means including an outer shell which has a height substantially equal to said inner shell height and which is adapted for circumscribing said inner shell over substantially said inner shell height, and said inner shell material is a closed-cell foam material, wherein said inner shell material has a compression deflection in the range of about 20 to 30 percent when about 2 to 5 psi of force is applied thereto, and wherein said outer shell material has a strength of at least about 800 psi.

6. A combination according to claim 5 wherein said inner shell material has a compression deflection in the range of about 20 to 30 percent when about 2 to 5 psi of force is applied thereto.

7. A combination according to claim 6 wherein said outer shell material has a strength of at least about 800 psi.

8. A combination according to claim 5 wherein said outer shell material has a strength of at least about 800 psi.

9. A pole protector according to claim 5 wherein said outer shell material is a fiber-reinforced polyvinylchloride, and said inner shell material is a neoprene foam.

10. A pole protector according to claim 5 wherein said outer shell material is polyester-reinforced polyvinylchloride.

11. A pole protector according to claim 5 wherein each of said inner and outer shell heights is between about 2 and 6 feet.

12. A pole protector according to claim 5 further comprising means for attaching opposite edge portions of said outer shell together.

13. A pole protector according to claim 12 wherein said attaching means comprises grommet means along at least one of the opposite edge portions of said outer shell.

14. In combination with a pole composed of wood, a protector for the pole comprising means for absorbing impacts with the pole, said impact-absorbing means including an inner shell which has a height and which circumscribes the pole and which is composed of impact-absorbing material, the pole protector further comprising means for protecting said inner shell from damage during the impacts and for intactly resisting the impacts, said protecting and impact resisting means including an outer shell having a height which is substantially equal to said inner shell height, said outer shell circumscribing said inner shell over substantially said inner shell height, and wherein said inner shell material is a closed-cell foam material.

15. A combination according to claim 14 wherein the pole is a utility pole.

16. A combination according to claim 14 wherein said inner shell material has a compression deflection in the range of about 20 to 30 percent when about 2 to 5 psi of force is applied thereto and wherein said outer shell material has a strength of at least about 800 psi.

17. A combination according to claim 14 wherein said outer shell material is a fiber-reinforced polyvinylchloride and wherein said inner shell material is a neoprene foam.

18. A combination according to claim 14 wherein said outer shell material is polyester-reinforced polyvinylchloride.

19. A combination according to claim 14 wherein said height of each of said inner and outer shells is between about 2 and 6 feet.

20. A combination according to claim 14 further comprising means for attaching opposite edge portions of said outer shell together.

* * * * *